US005722652A

United States Patent [19]

Yoshida et al.

[11] Patent Number: 5,722,652

[45] Date of Patent: Mar. 3, 1998

[54] SHEET FEEDING APPARATUS WITH SHEET ABSORB MEANS AND A CONVEYOR CONTROLLED FOR FORWARD AND REVERSE CONVEYING DIRECTIONS

[75] Inventors: Yasumi Yoshida, Yokohama; Ryusei Kominato, Tokyo; Shinsuke Ubayashi, Yokohama, all of Japan

[73] Assignee: Canon Kabushiki Kaisha, Tokyo, Japan

[21] Appl. No.: 328,822

[22] Filed: Oct. 25, 1994

[30] Foreign Application Priority Data

Oct. 28, 1993 [JP] Japan ..... 5-270594
Oct. 28, 1993 [JP] Japan ..... 5-270595

[51] Int. Cl.[6] ..... B65H 5/08

[52] U.S. Cl. ..... 271/11; 271/10.03; 271/98; 271/99; 271/104; 271/265.02; 271/225; 271/902; 271/161

[58] Field of Search ..... 271/10.03, 11, 271/12, 95, 98, 99, 161, 104, 258.01, 902, 225, 265.01, 265.02

[56] References Cited

U.S. PATENT DOCUMENTS 3,874,655 4/1975 Allen et al. ..... 271/99
4,606,535 8/1986 Larson ..... 271/10.03
4,813,660 3/1989 Dodd et al. ..... 271/98 X
4,889,331 12/1989 Sardella ..... 271/11
5,060,925 10/1991 Hamakawa et al. ..... 271/265.01 X
5,181,709 1/1993 Okada et al. ..... 271/99 X
5,298,959 3/1994 Saito et al. .

*Primary Examiner*—Boris Milef
*Attorney, Agent, or Firm*—Fitzpatrick, Cella, Harper & Scinto

[57] ABSTRACT

A sheet feeding apparatus with a sheet supporting unit for supporting sheets, a sheet absorb device for air-absorbing a lowermost sheet from among the sheets supported by the sheet supporting unit, a conveyer for conveying the sheet absorbed to the sheet absorb device, a regulator for regulating a downward movement of the sheets supported by the sheet supporting unit by abutting tip ends of such sheets against the regulator, a passage arranged between the conveyer and the regulator and adapted to guide the sheet conveyed by the conveyer, and a controller for driving the conveyer in a reverse direction after the sheet conveyed by the conveyer is fed out through the passage.

8 Claims, 9 Drawing Sheets

SHEET FEEDING APPARATUS WITH SHEET ABSORB MEANS AND A CONVEYOR CONTROLLED FOR FORWARD AND REVERSE CONVEYING DIRECTIONS

BACKGROUND OF THE INVENTION

1. Field of the Invention

The present invention relates to a sheet feeding apparatus for supplying an original or a recording sheet to an image forming apparatus such as a facsimile, a copying machine, a printer and the like. More particularly, it relates to an air sheet feeding apparatus for separating and supplying a sheet one by one from a lowermost one from a sheet stack rested on a sheet tray by utilizing air suction.

2. Related Background Art

In the past, sheet feeding apparatuses of roller type wherein sheets stacked on a sheet tray are supplied downstreamly one by one by rotation of a sheet supply roller (rubber roller) have widely been used as a sheet feeding apparatus for supplying an original or a recording sheet (referred to as "sheet" hereinafter) to an image forming apparatus. In such a conventional sheet feeding apparatus, since a surface of the sheet supply roller is constituted by an elastic body such as rubber so that sheet supplying ability greatly depends upon the coefficient of friction of the elastic body, the sheet supplying ability becomes unstable by the change in diameter of the roller due to wear, deterioration of material by which the roller is formed, and/or the change in coefficient of friction of the roller surface due to adhesion of paper powder or the like, and the sheet supply roller cannot be coped with various sheets having different surface conditions, thereby causing the poor sheet supply.

In order to eliminate the above drawback, an air sheet feeding apparatus for absorbing and conveying a sheet by utilizing an air suction force has been proposed.

In general, such an air sheet feeding apparatus comprises a convey belt having a plurality of absorb holes formed therein, and a blower for sucking air through the absorb holes so that the sheet rested on a sheet tray is absorbed to the convey belt and the sheet is separated from the other sheets by driving the convey belt. However, in the conventional air sheet feeding apparatus, if the sheet is thin, the absorbing force also acts on a second sheet and so on, so that the second sheet and so on are also absorbed and conveyed, or plural sheets are double-fed due to adhesion between sheet fibers or an electrostatic force, thereby causing the poor sheet supply. Particularly, in the sheet feeding apparatus of lower separation type (in which the stacked sheets are separated one by one from the lowermost one), since the lower sheets in the sheet stack are pressurized by the weight of the sheet stack itself, two or more sheets are apt to be supplied simultaneously.

SUMMARY OF THE INVENTION

An object of the present invention is to provide an air sheet feeding apparatus of lower separation type in which sheets are surely separated and supplied one by one.

In the present invention, a lowermost sheet in a sheet stack supported by a sheet supporting means is air-absorbed by a sheet absorb means, and the absorbed sheet is conveyed by a convey means. The sheet conveyed by the convey means is fed downstreamly along a sheet path, and the remaining sheets are prevented from shifting downstreamly by abutting tip ends of the remaining sheets against a regulation means.

After the lowermost sheet absorbed by the sheet absorb means is conveyed by the convey means, by driving the convey means in a reverse direction, the tip ends of the remaining sheets are separated from the regulation means. In this way, after the lowermost sheet is fed out, even if the tip ends of the remaining sheets are bent upwardly by abutting against the regulation means or even if a next sheet cannot be fed out because of the strong abutment between the tip ends of the remaining sheets and the regulation means, by driving the convey means in the reverse direction to separate the tip ends of the remaining sheets from the regulation means, the next sheet can surely be absorbed, separated and conveyed.

Further, preferably, the sheet absorb means comprises a first sheet absorb portion and a second sheet absorb portion arranged along a sheet conveying direction, and an absorb surface of the second sheet absorb portion is inclined with respect to an absorb surface of the first sheet absorb portion by a predetermined angle.

With this arrangement, when the lowermost sheet is absorbed by the second sheet absorb portion, although the lowermost sheet is deformed, since the remaining sheets are not deformed due to their resiliency, the lowermost sheet can surely be separated from the remaining sheets. Further, since the remaining sheets cannot be shifted downstreamly by the regulation means, during the conveyance of the lowermost sheet, the remaining sheets are not fed out together with the lowermost sheet.

Furthermore, in order to improve the separation of the sheet, at a downstream side of the sheet supporting means, there may be arranged a first air injecting means for injecting air between the lowermost sheet and the other sheets to separate the lowermost sheet from the other sheets, and a second air injecting means for injecting air to urge the lowermost sheet toward the sheet absorb means.

With this arrangement, by the injected air, the lowermost sheet is urged against the sheet absorb means and the other sheets are biased to separate from the lowermost sheet.

DETAILED DESCRIPTION OF THE PREFERRED EMBODIMENTS

Figure 1:
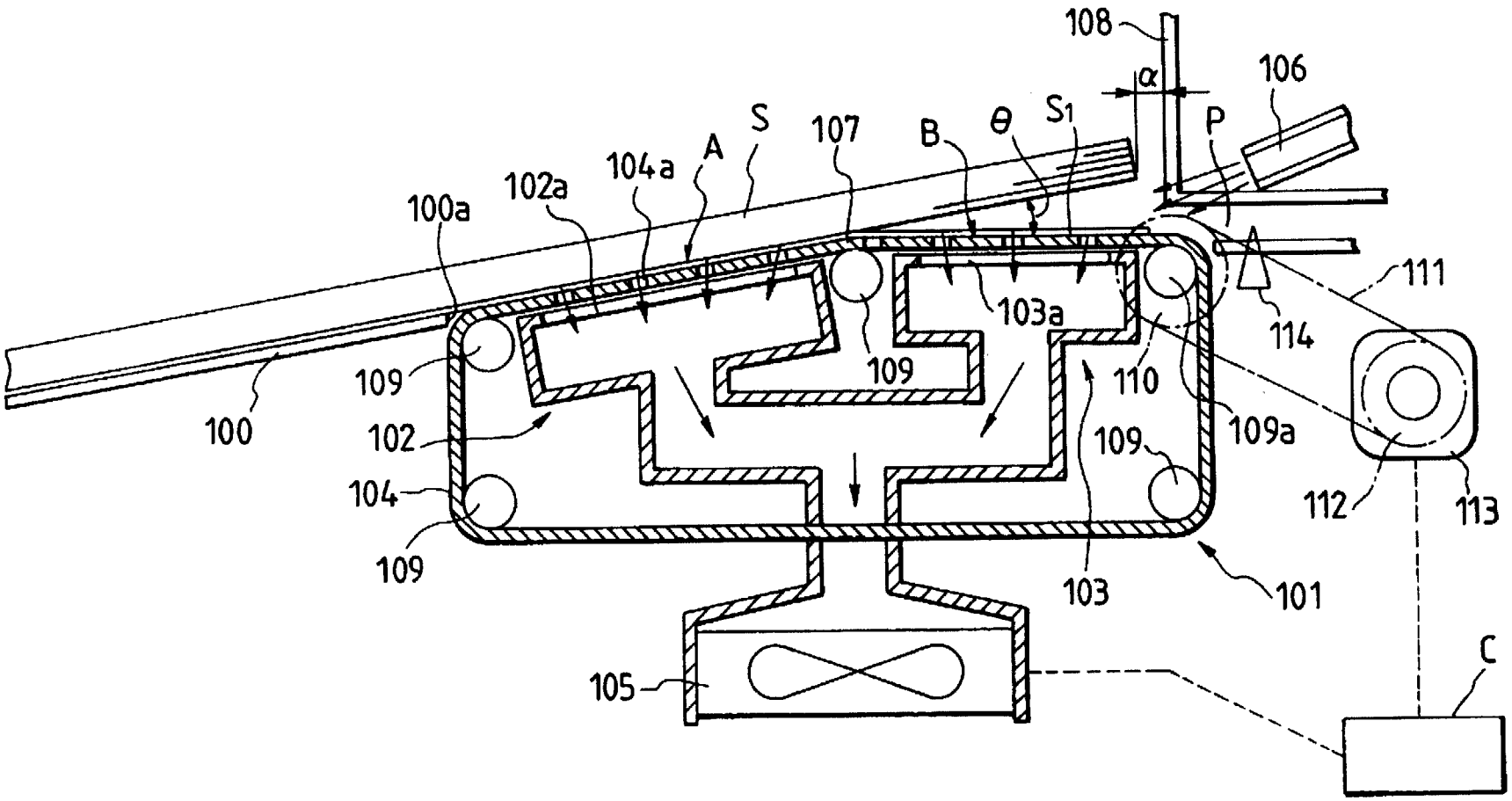
FIG. 1 is a longitudinal sectional view of a sheet feeding apparatus according to a first embodiment of the present invention.
Figure 2:
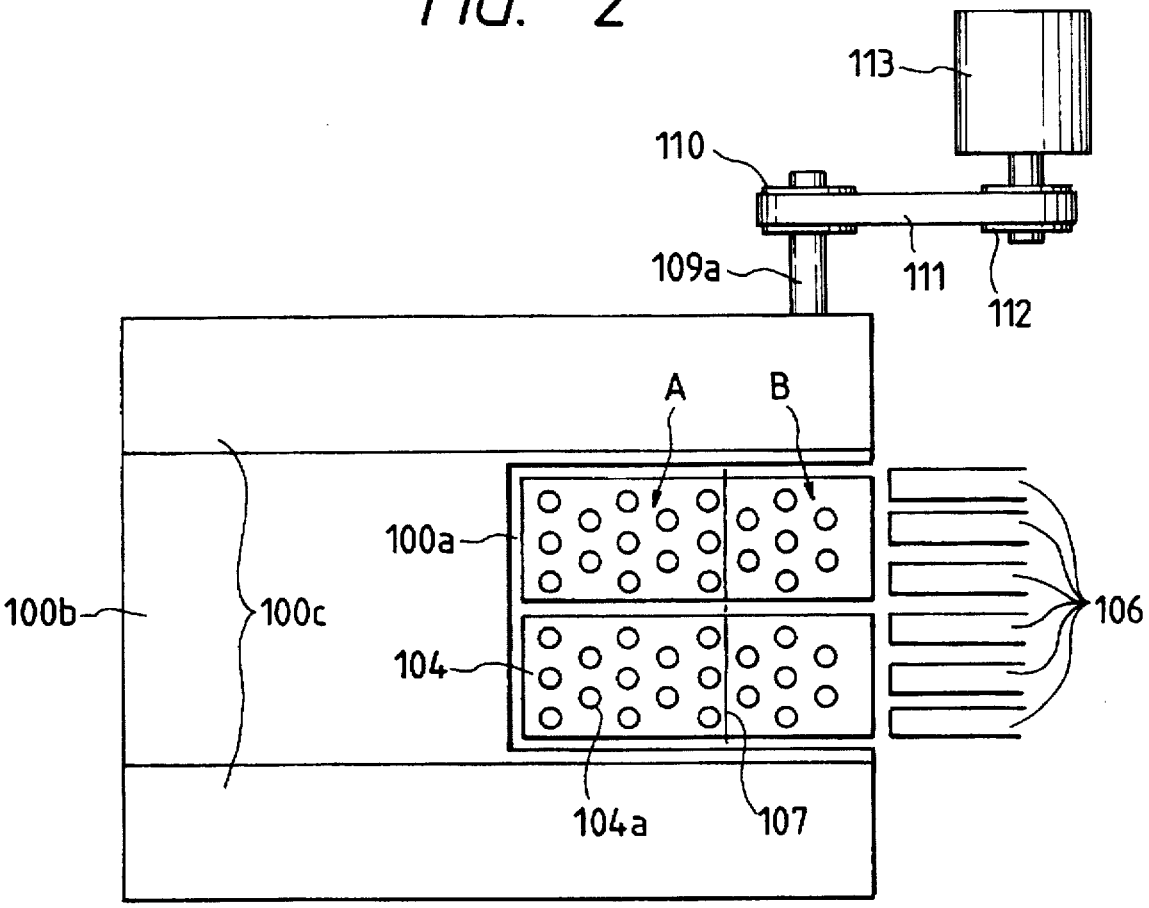
FIG. 2 is a plan view of the sheet feeding apparatus of FIG. 1.
Figure 3:
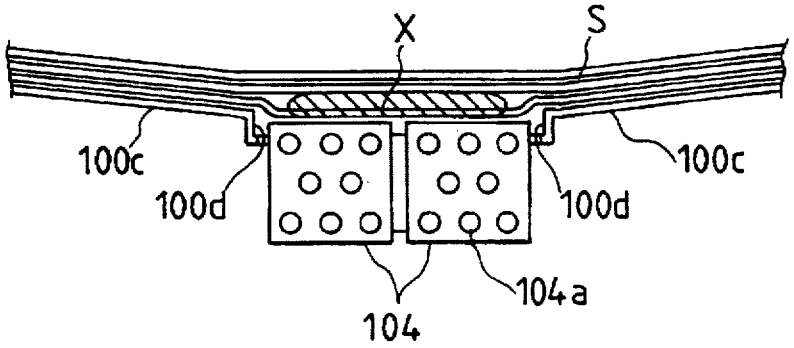
FIG. 3 is a right side view of the sheet feeding apparatus of FIG. 1.

Now, a sheet feeding apparatus according to a first embodiment of the present invention will be explained with reference to FIGS. 1 to 5. First of all, a construction of the sheet feeding apparatus will be described with reference to FIGS. 1 to 3. FIG. 1 is a longitudinal sectional view of the sheet feeding apparatus. FIG. 2 is a plan view of the sheet feeding apparatus and FIG. 3 is a right side view of the sheet feeding apparatus.

The sheet feeding apparatus 101 comprises a sheet tray 100 on which a plurality of sheets S are stacked, a sheet absorb means arranged below a tip end portion of the sheet stack S rested on the sheet tray 100, a convey means for conveying the sheet S absorbed to the sheet absorb means, air injecting nozzles 106 for injecting air toward the tip end of the sheet stack S rested on the sheet tray 100, and a guide plate 108 for regulating the tip end of the sheet stack S.

The sheet absorb means includes a first suction chamber 102 having an upper suction opening 102*a*, and a second suction chamber 103 having an upper suction opening 103*a*. The first suction chamber 102 disposed at an upstream side of the second suction chamber is arranged so that the suction opening 102*a* is inclined upstreamly and downwardly, and the second suction chamber 103 disposed at a downstream side of the first suction chamber is arranged so that the suction opening 103*a* extends substantially horizontally. The first and second suction chambers 102, 103 are connected to a common blower 105. Incidentally, the first and second chambers 102, 103 may be formed separately and be controlled independently.

The convey means comprises a convey belt 104 arranged to cover the suction openings 102*a*, 103*a* of the first and second suction chambers 102, 103. The convey belt 104 has a plurality of suction holes 104*a* formed therein and is mounted on a plurality of rollers 109 so that a belt portion is bent by a predetermined angle θ at transit point 107 between the first and second suction chambers 102, 103.

Incidentally, a first absorb portion A is constituted by the first suction chamber 102 and a belt portion corresponding to the first suction chamber, and a second absorb portion B is constituted by the second suction chamber 103 and a belt portion corresponding to the second suction chamber. Accordingly, an absorb surface of the first absorb portion A is inclined at the angle θ and an absorb surface of the second absorb portion B extends substantially horizontally.

Further, the convey belt 104 is driven by a pulley 110 fixed to an upstream upper roller 109*a*, a pulley 112 fixed to a drive shaft of a motor 113, and a timing belt 111 extending between these pulleys. The motor 113 is a reversible stepping motor, and rotation of the motor is controlled by a control means C.

As shown in FIG. 2, a notch 100*a* is formed in the sheet tray 100, and the sheet absorb means and the convey means are arranged within the notch 100*a*. Further, the sheet tray 100 has a base bottom portion 100*b* (positioned centrally in a widthwise direction), side portions 100*c* inclined upwardly from the base bottom portion 100*b* in the widthwise direction. The base bottom portion 100*b* extends substantially in parallel with the absorb surface of the first suction chamber 102 and is arranged to be uniformly contacted with the sheet S.

The air injecting nozzles 106 are arranged to inject the air from the above toward the absorb surface of the second absorb portion B. Further, the air injecting nozzles 106 are distributed in a zone corresponding to the absorb area of the convey belt 104 to inject the air into a hatched area X shown in FIG. 3. The air injecting nozzles 106 are connected to the blower 105 so that the air sucked by the blower is injected from the nozzles 106. Incidentally, a valve (not shown) is associated with the nozzles 106 to control the supply and stop of the air and to adjust an amount of the injected air.

The guide plate 108 for regulating the tip end of the sheet stack S rested on the sheet tray 100 is vertically arranged at a position corresponding to a downstream end of the convey belt 104, so that the tip end of the sheet stack S can be abutted against the guide plate to prevent the downward movement of the sheet stack. A passage P for feeding out the separated sheet S is formed between the guide plate 108 and the convey belt 104.

A sheet detection sensor 114 for detecting the separated sheet S is arranged at an inlet of the passage P.

Incidentally, the motor 113 and the blower 105 of the sheet feeding apparatus 101 are appropriately controlled by the control means C. Further, in place of the ON/OFF control of the blower 105, a valve may be provided between the blower 105 and the suction chambers 102, 103 so that the opening and closing of the valve can be controlled. In this case, the sheet absorbing operation and the air injecting operation of the nozzles 106 can be controlled independently.

Figure 4:
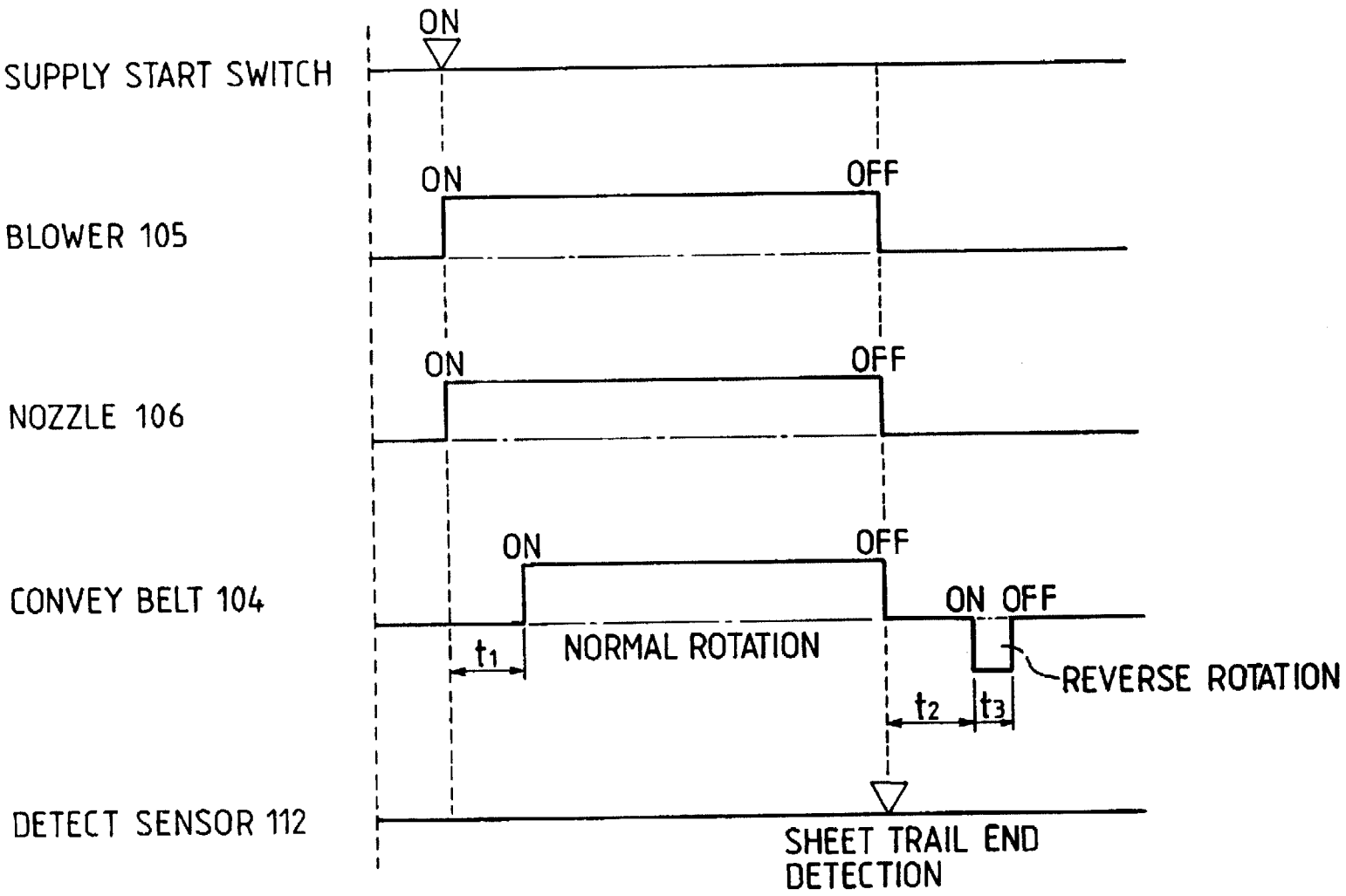
FIG. 4 is a timing chart showing control for the sheet feeding apparatus of FIG. 1.

Next, the operation of the sheet feeding apparatus will be explained with reference to a timing chart shown in FIG. 4.

The sheets S are stacked on the sheet tray 100 and a sheet supply start switch (not shown) is turned ON. When the sheet supply start switch is turned ON, the blower 105 is activated, so that the air is sucked through the suction openings 102*a*, 103*a* of the first and second suction chambers 102, 103 and the suction holes 104*a* of the convey belt 104. Consequently, the lowermost sheet $S_1$ in the sheet stack S rested on the sheet tray 100 is absorbed to the first and second absorb portions A, B. Since the absorb surface of the first absorb portion A is inclined with respect to the absorb surface of the second absorb portion B by the angle θ, only the lowermost sheet $S_1$ is bent to be contacted to the convey belt 104 at the second absorb portion B and the other sheets are not bent to maintain their straight conditions due to the resiliency of the sheet, thereby separating the lowermost sheet from the other sheets (FIG. 1).

By the way, several sheets S may be bent along the convey belt 104 due to the adhesion between the fibers of the sheets. In such a case, however, since the air is injected from the air injecting nozzles 106, the contacted sheets S can be separated from each other. In this way, the lowermost sheet $S_1$ can surely be separated from the other sheets S.

After a predetermined time $t_1$ is elapsed, the convey belt 104 is rotated in a clockwise direction (FIG. 1) by the motor 113, with the result that the lowermost sheet $S_1$ is conveyed downstreamly while being absorbed to the convey belt 104, thereby separating the lowermost sheet from the other sheet S. In this case, since the air injected from the air injecting nozzles 106 flows between the lowermost sheet $S_1$ and the other sheets S toward a trailing end of the sheet stack to float the other sheet S, only the lowermost sheet $S_1$ can be positively conveyed downwardly through the passage P.

Figure 5:
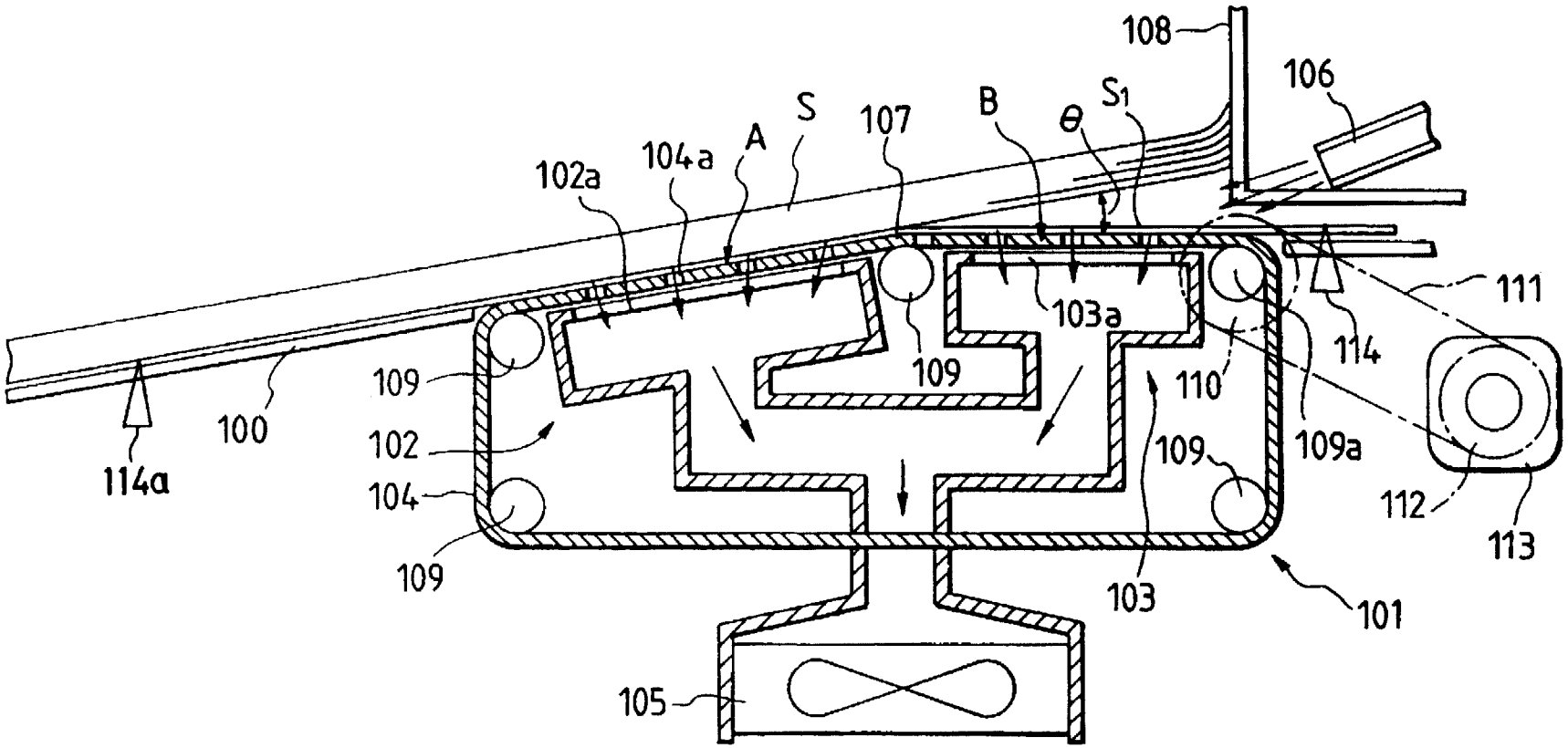
FIG. 5 is a longitudinal sectional view of the sheet feeding apparatus of FIG. 1, showing an operation of the apparatus.

However, if a large amount sheets are stacked on the sheet tray or the coefficient of friction between the sheets is great, several sheets may be shifted downwardly together with the lowermost sheet. In such a case, the several sheets are stopped against the guide plate 108. In this case, since the remaining sheets continue to be urged against the guide plate 108 during the downward conveyance of the lowermost sheet $S_1$, if the sheet is thin, the tip end portions of the remaining sheets may be temporarily bent upwardly, as shown in FIG. 5. In such a case, when the next sheet tries to be absorbed to the second absorb portion B, since the bent tip end of the sheet is caught by the guide plate 108 to prevent the complete absorption of the next sheet, the poor sheet supply may occur.

In order to avoid this, after the supply of the lowermost sheet $S_1$ is completed, when the trailing end of the lowermost sheet $S_1$ passing through the passage P is detected by the sensor 114, the control means C stops the motor 113 by a predetermined time $t_2$. Thereafter, the motor 113 is rotated reversely by a short time $t_3$ to rotate the convey belt 104 reversely by a small amount (in an anti-clockwise direction in FIG. 1). This amount is selected so that the tip end of the sheet stack S is separated from the guide plate 108 by a distance of $\alpha$.

Incidentally, when the control means C receives the detection signal from the sensor 114, the control means disenergizes the blower 105 to stop the injection of air from the nozzles 106.

In this way, the sheet stack S is waiting for the next sheet supply in a condition that the tip end thereof is spaced apart from the guide plate 108 by the distance $\alpha$. Since the sheet stack is waiting while separating from the guide plate 108, the tip ends of the sheet are not bent upwardly and it is not difficult to absorb the next sheet to the second absorb portion B because of no load acting on the sheet from the guide plate 108. Thus, the sheet can surely be separated and supplied.

Incidentally, while the timing for rotating the convey belt 104 reversely is determined by the detection of the trailing end of the sheet $S_1$ by means of the sensor 114, a time period from when the conveyance of the lowermost sheet $S_1$ is started to when the trailing end of the lowermost sheet leaves the tip end of the sheet stack S may be previously determined on the basis of sheet length information from a sheet size detection means 114*a* so that the convey belt 104 is rotated on the basis of the predetermined time period. Alternatively, the fact that the tip end of the conveyed sheet is pinched between a pair of downstream convey rollers (not shown) may be detected and the convey belt 104 may be rotated reversely on the basis of such detection.

Figure 6:
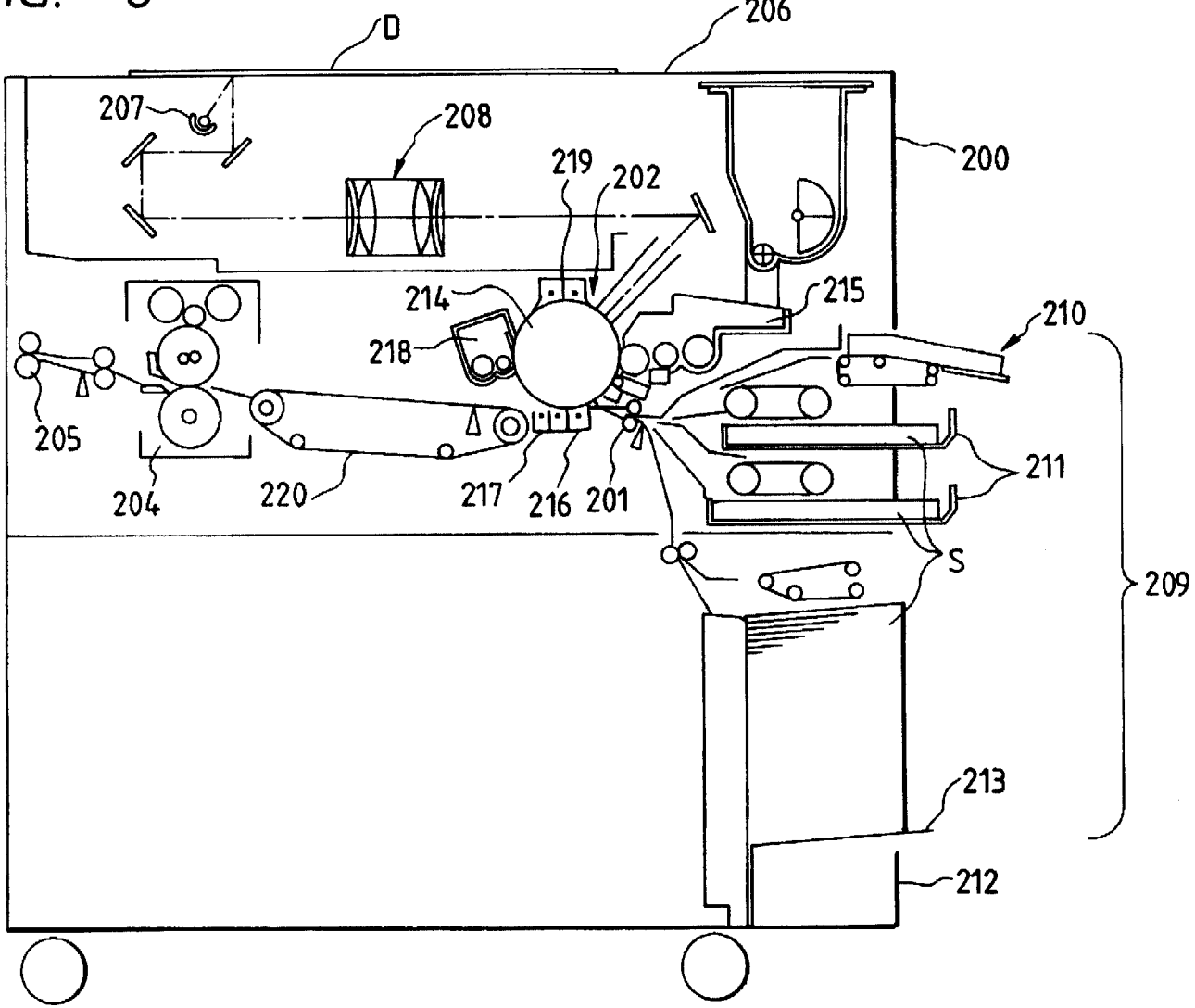
FIG. 6 is a longitudinal sectional view of an image forming apparatus having a sheet feeding apparatus of the present invention.

FIG. 6 shows an example of an image forming apparatus (copying machine) having the above-mentioned sheet feeding apparatus. Now, the image forming apparatus will be briefly explained.

The image forming apparatus 200 comprises an original resting plate 206, a light source 207, a lens system 208, a sheet supply portion 209 and an image forming portion 202. The sheet supply portion 209 includes a sheet supply tray 210 to which the above-mentioned sheet feeding apparatus is connected, cassette 211 and a paper deck 213 arranged on a pedestal 212. The image forming portion 202 includes a cylindrical photosensitive body 214, a developing device 215 containing toner therein, a transfer charger 216, a separation charger 217, a cleaner 218 and a first charger 219. A convey device 220, a fixing device 204 and a pair of discharge rollers 205 are arranged at a downstream side of the image forming portion 202.

Next, an operation of the image forming apparatus will be explained.

When a sheet supply signal is emitted from a control device of the image forming apparatus 200, a sheet S is supplied from the sheet supply tray 210, cassette 211 or paper deck 213. On the other hand, light (emitted from the light source 207) reflected by an original D rested on the original resting plate 206 is incident to the photosensitive body 214 through the lens system 208. The photosensitive body 214 is previously charged by the first charger 219. When the photosensitive body 214 is illuminated by the light, an electrostatic latent image is formed on the photosensitive body. The latent image is then developed by the developing device 215 as a toner image.

The skew-feed of the sheet S supplied from the sheet supply portion 209 is corrected by a pair of registering rollers 201, and the sheet is then sent to the image forming portion 202 at a predetermined timing. In the image forming portion 202, the toner image is transferred onto the sheet S by means of the transfer charger 216. Thereafter, the sheet S is separated from the photosensitive body 214 by applying voltage having polarity opposite to that of the transfer charger 216 to the sheet by means of the separation charger 217.

The separated sheet S is sent, by the convey device 220, to the fixing device 204, where the toner image is permanently fixed to the sheet S. Then, the sheet S on which the image was fixed is discharged out of the image forming apparatus by the pair of discharge rollers 205. In this way, the image is formed on the sheet supplied from the sheet supply portion 209 and the imaged sheet is discharged.

Incidentally, the present invention is not limited to the above embodiment. For example, in the illustrated embodiment, while the air sucked by the blower 105 was injected from the nozzles 106, an additional blower for the nozzles 106 may be provided to control the blower 105 and the nozzles 106 independently.

Further, in the illustrated embodiment, while the sheet feeding apparatus for supplying the sheet on which the image is to be transferred was explained, the sheet feeding apparatus max be applied to other systems, for example, such as an automatic original feeding apparatus for automatically feeding an original to a reading station.

Further, in the illustrated embodiment, while an example that the present invention is applied to the air sheet feeding apparatus having the first and second absorb portions A, B to separate the sheets by bending the lowermost sheet was explained, the present invention may be applied to an air sheet feeding apparatus wherein sheets are horizontally supported and a lowermost sheet is absorbed to a single absorb portion to feed out the sheet horizontally.

Next a second embodiment of the present invention will be explained. In the second embodiment, two kinds of air injecting nozzles for injecting air are provided. Since the construction other than the air injecting nozzles is the same as that of the first embodiment, the same elements are designated by the same reference numerals and detailed explanation thereof will be omitted.

Figure 7:
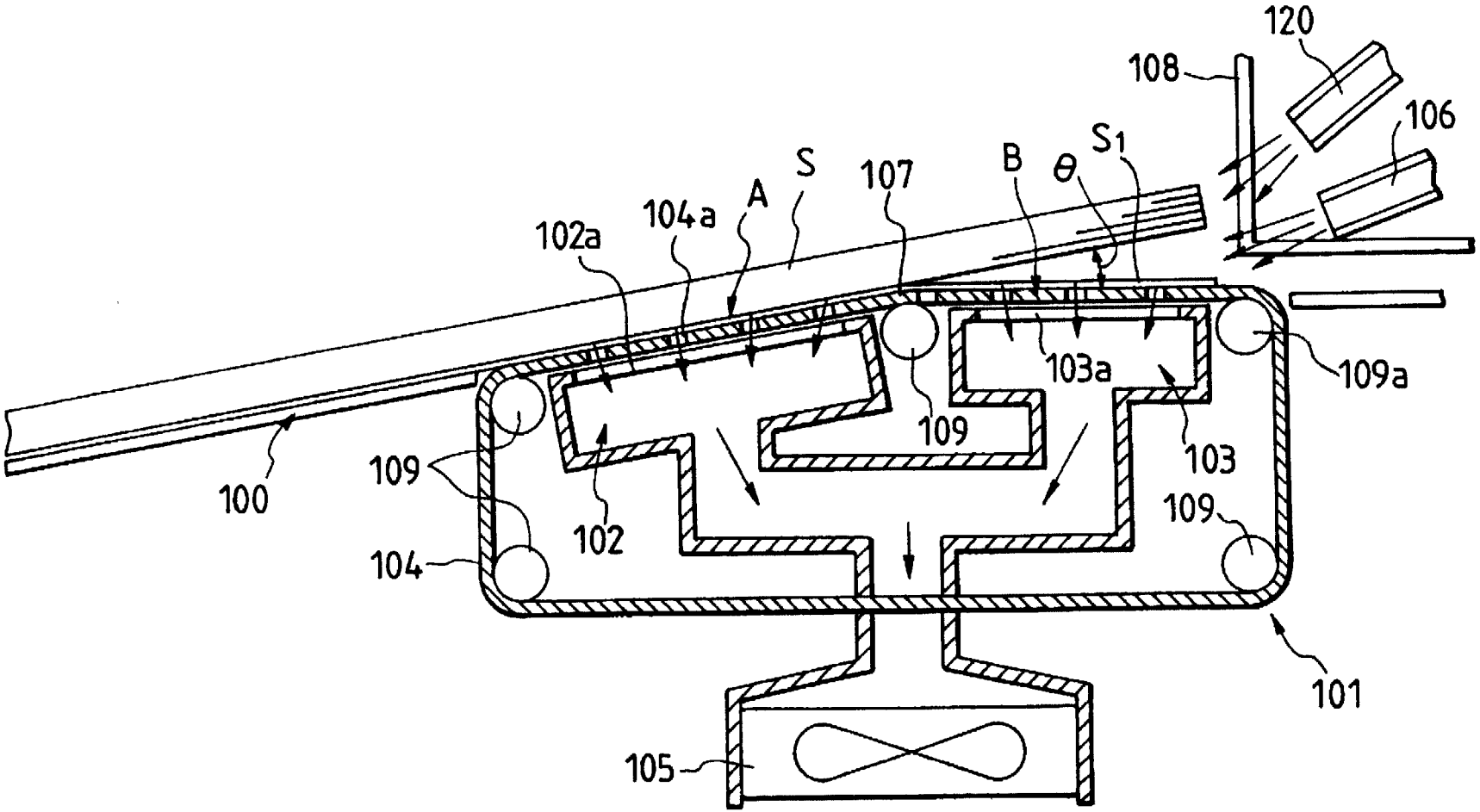
FIG. 7 is a longitudinal sectional view of a sheet feeding apparatus according to a second embodiment of the present invention.

As shown in FIG. 7, first and second air injecting nozzles 106, 120 for injecting air toward the tip end of the sheet stack S rested on the sheet tray 100 are disposed at a downstream side of the sheet tray 100.

Figure 8:
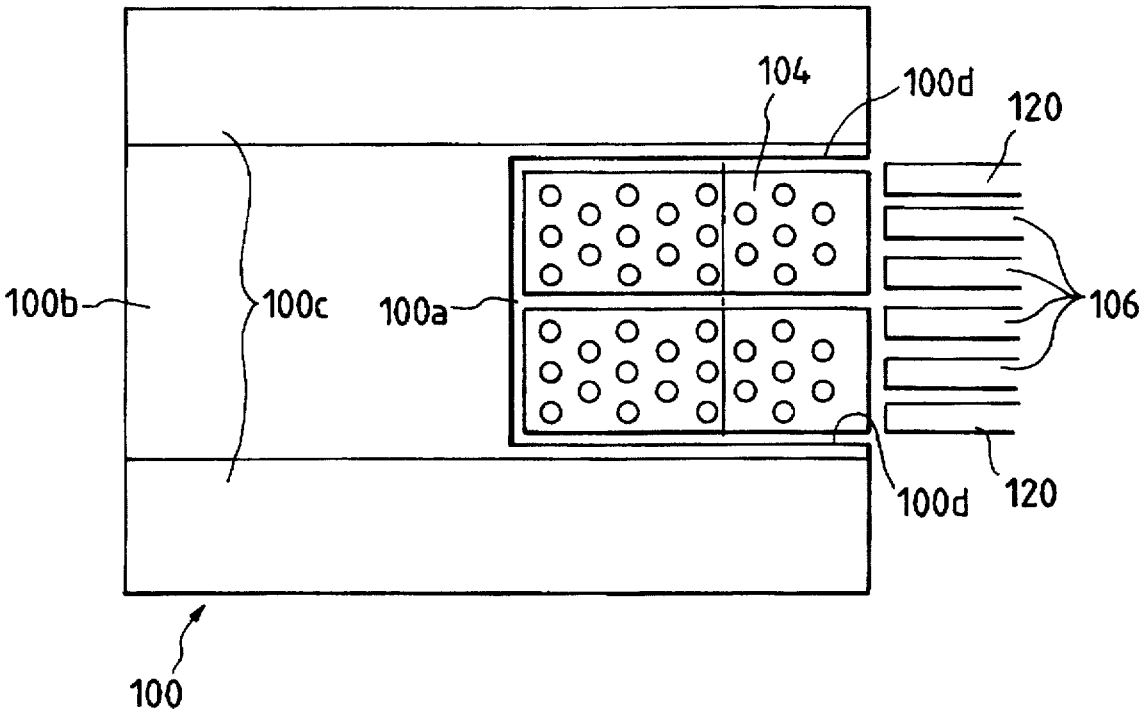
FIG. 8 is a plan view of the sheet feeding apparatus of FIG. 7.

The first air injecting nozzles 106 serve to inject the air against the upper surface of the second absorb portion B from above. As shown in FIG. 8, the first air injecting nozzles 106 are arranged in the area corresponding to the sheet absorbing area of the convey belt 104 (in the widthwise direction) so that the air injected from the nozzles 106 is directed in a hatched zone X in FIG. 10.

Figure 9:
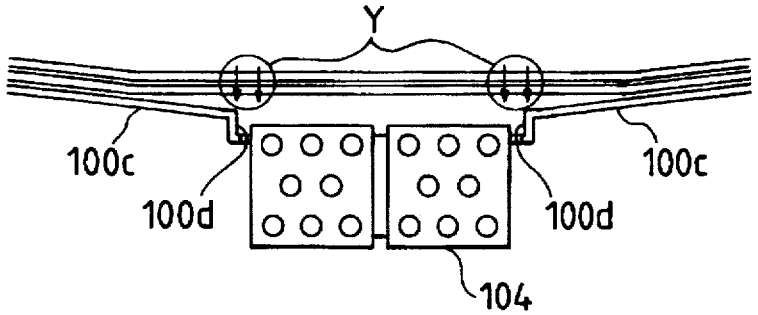
FIGS. 9 and 10 are right side views of the sheet feeding apparatus of FIG. 7.

The second air injecting nozzles 120 are arranged on both sides of the first air injecting nozzles 106 to face with both ends of the sheet absorbing area of the convey belt 104 or both ends of the notch 100*a* in the widthwise direction and are disposed substantially the same position as the first air injecting nozzles in the sheet conveying direction. As shown in FIG. 9, the second air injecting nozzles 120 are arranged to inject the air toward end portions Y of the sheet which are not absorbed. A relative angle between a direction of air flow injected from the second air injecting nozzles 120 and the absorb surface of the second absorb portion B is greater than a relative angle between a direction of air flow injected from the first air injecting nozzles 106 and the absorb surface of the second absorb portion B. With this arrangement, since the air injected from the second air injecting nozzles 120 urges the tip end portion of the sheet downwardly, even if the sheets are curled so that the lowermost sheet $S_1$ is not absorbed by the second suction chamber 103, by injecting the air from the second air injecting nozzles 120, the sheet $S_1$ is positively absorbed to the convey belt 104.

Figure 10:
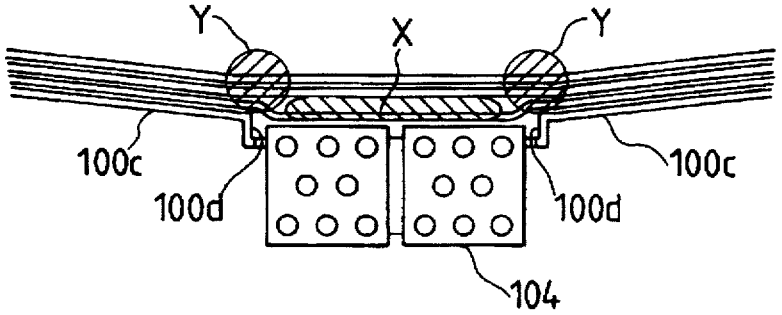

Further, as shown in FIG. 10, since the sheet is subjected to the downward force by the air injected from the second air injecting nozzles 120 only at both widthwise ends of the absorbing area of the convey belt 104, if several sheets S are biased toward the second suction chamber 103, since the air injected from the first air injecting nozzles 106 disposed between the second air injecting nozzles 120 is directed to the hatches zone X to separate the sheets, only the lowermost sheet $S_1$ can be absorbed to the convey belt.

Next, an operation of the sheet feeding apparatus according to the second embodiment will be explained.

The sheet is absorbed to the convey belt 104 by sucking the air through the suction openings 102*a*, 103*a* of the first and second suction chambers 102, 103 and the suction holes 104*a* of the convey belt 104 by means of the blower 105.

Since the absorb surfaces are inclined with respect to each other by the angle θ, only the lowermost sheet $S_1$ is absorbed and the other sheets are maintained in their straight conditions due to the resiliency of the sheet, thereby separating only the lowermost sheet from the sheet stack. In this case, when the sheet is a thick sheet having great resiliency or if the sheet is curled, the tip end portion of the sheet cannot be absorbed to the convey belt 104 by the second suction chamber 103. In such a case, however, since the lowermost sheet $S_1$ is urged toward the convey belt 104 by the air injected from the second air injecting nozzles 120, the sheet $S_1$ can surely be absorbed to the convey belt.

Further, even if several sheets are urged toward the convey belt 104 by the air injected from the second air injecting nozzles 120, since the sheets other than the lowermost sheet $S_1$ are separated from the convey belt 104 by the air injected from the first air injecting nozzles 106, only the lowermost sheet $S_1$ is absorbed to the convey belt 104 and conveyed by the convey belt. In this way, even when the sheet is a thick sheet having great resiliency or even if the sheet is curled, the sheets can surely be separated one by one.

Figure 11:
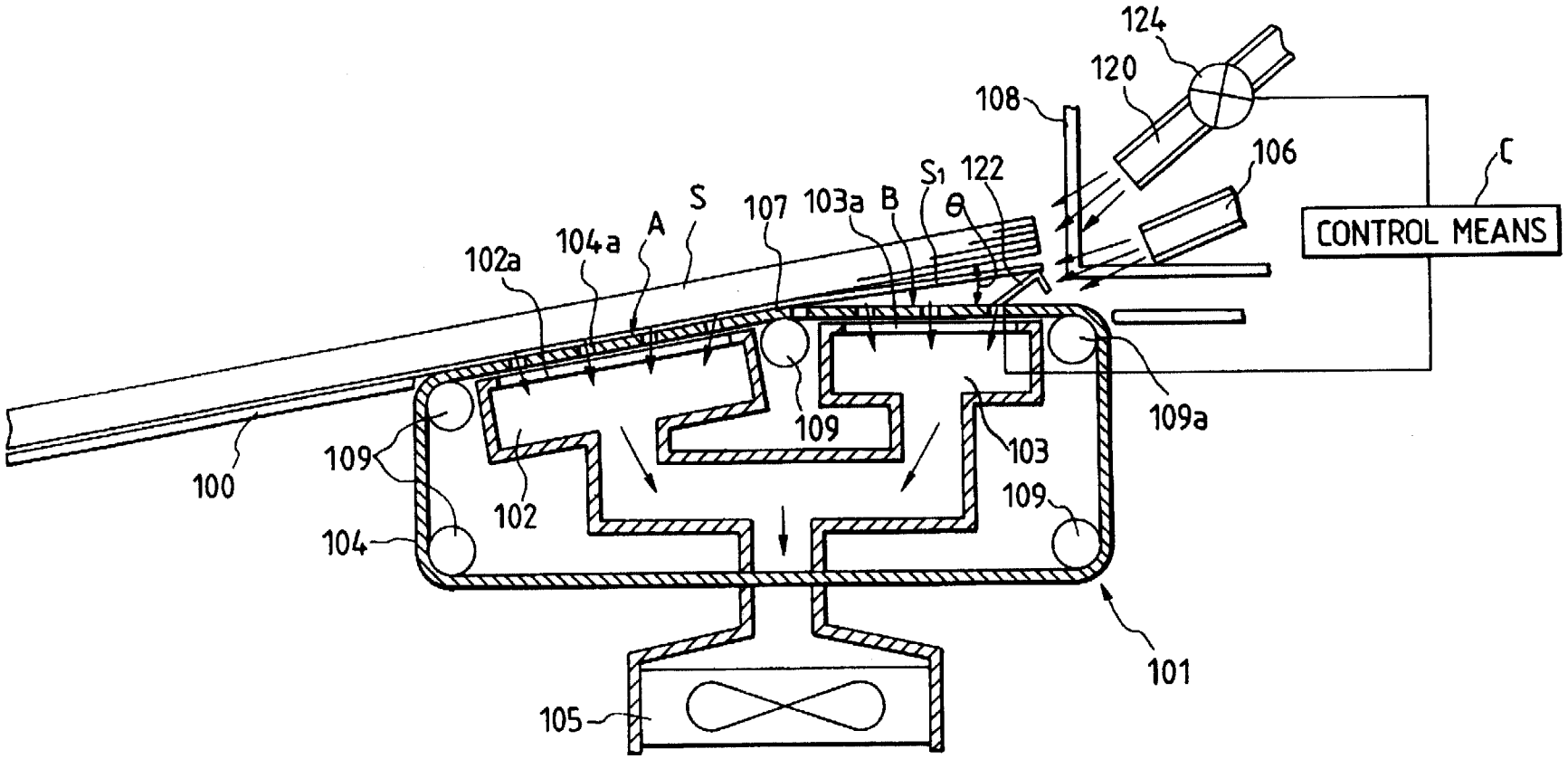
FIG. 11 is a longitudinal sectional view of a sheet feeding apparatus according to a third embodiment of the present invention.

Next, a third embodiment of the present invention will be explained with reference to FIGS. 11 to 13. The third embodiment differs from the second embodiment only in that there are provided a sheet detection sensor 122 disposed in the proximity of the second absorb portion B and a control means C for controlling the air injection from the nozzles. Since the other construction is the same as that of the second embodiment, detailed explanation thereof will be omitted.

Figure 12:
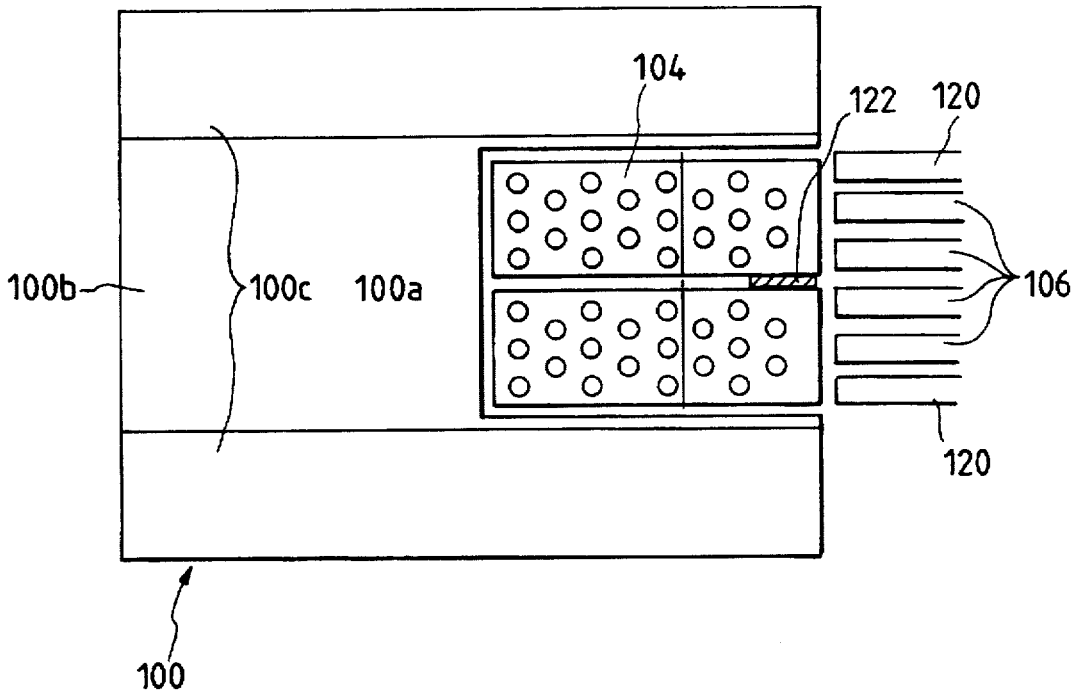
FIG. 12 is a plan view of the sheet feeding apparatus of FIG. 11.

A sheet detection sensor 122 serving to detect an absorbing condition of the lowermost sheet $S_1$absorbed to the second absorb portion B is arranged between a pair of convey belts 104, as shown in FIG. 12. A detection signal from the sheet detection sensor 122 is inputted to a control means C. A valve 124 for adjusting an air amount is associated with the second air injecting nozzles 120, and the valve is controlled by the control means C.

Next, an operation of the sheet feeding apparatus according to the third embodiment will be explained with reference to a timing chart shown in FIG. 13.

Figure 13:
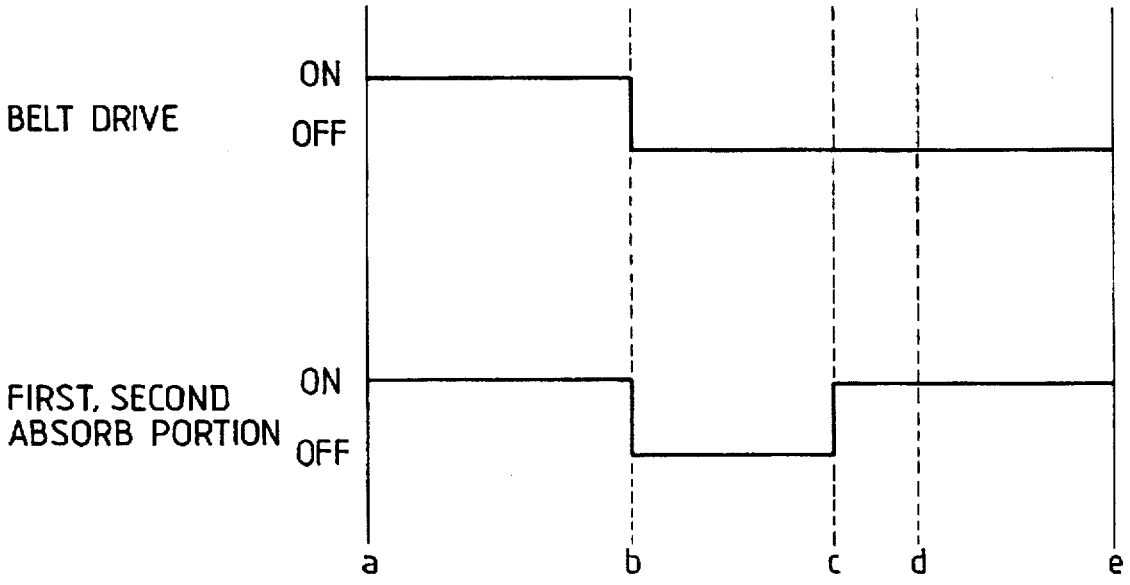
FIG. 13 is a timing chart showing sheet supply timing.

FIG. 13 shows an ON/OFF timing of the convey belt 104, and an ON/OFF timing of the sheet absorb portions A, B in one cycle of the sheet supply. A point a indicates a start point of the sheet supply, and a point e indicates a finish point of the sheet supply and a start point of the next sheet supply. The sheet $S_1$ absorbed to the sheet absorb portions A, B at the point a is conveyed by driving the convey belt 104. When the tip end of the sheet $S_1$ is pinched between a pair of downstream convey rollers (not shown), the convey belt 104 is turned OFF and the blower 105 is also turned OFF to de-energize the first and second suction chambers 102, 103 (point b).

The sheet $S_1$ conveyed by the pair of convey rollers completely leaves the second suction chamber 103, the blower 105 is turned ON to energize the first and second suction chambers 102, 103 (point c). As a result, the tip end portion of the next sheet is sucked by the second suction chamber 103 to be absorbed to the convey belt 104 (point d) for preparing for the next sheet supply. When the point e is achieved, the above-mentioned operations are repeated.

The time period c–d from when the first and second suction chambers 102, 103 are re-energized after the trailing end of the sheet $S_1$ leaves the second suction chamber 103 to when the tip end of the next sheet is sucked by the second suction chamber 103 is normally 0.1–0.2 second. If the time period is too long, the next sheet supply cannot be effected completely, thereby causing the poor sheet supply. To avoid this in the third embodiment, as shown in FIG. 11, the sheet detection sensor 122 is arranged in the proximity of the second suction chamber 103 to detect the time period c–d. If the time period exceed a predetermined value, the amount of air injected from the second air injecting nozzles is increased to facilitate the absorption of the sheet to the second absorb portion B.

More particularly, if the time period c–d exceeds the predetermined value (for example, 0.3 second), the valve 124 for adjusting the amount of air injected from the second air injecting nozzles is adjusted by the control means C to increase the air amount, thereby maintaining the sheet absorbing time within a predetermined time period. When a series of operations are finished, the valve 124 is returned to the initial condition to return the air amount from the second air injecting nozzles 120 to a standard value. Thus, in the third embodiment, by adjusting the air amount injected from the second air injecting nozzles 120, the sheet absorbing time of the second suction chamber 103 is maintained within the predetermined time period, thereby preventing the poor sheet supply.

What is claimed is:

1. A sheet feeding apparatus, comprising:

sheet supporting means for supporting sheets;

sheet absorb means for air-absorbing a lowermost sheet from among the sheets supported by said sheet supporting means;

convey means for conveying the sheet absorbed to said sheet absorb means;

regulation means for regulating a downward movement of the sheets supported by said sheet supporting means by abutting tip ends of the sheets against said regulation means;

size detection means for detecting a size of the sheets supported by said sheet supporting means, and control means for determining a sheet conveying time of said convey means on the basis of a detection result of said size detection means to drive said convey means in the reverse direction after the sheet conveying time is elapsed.

2. A sheet feeding apparatus according to claim 1, wherein said sheet absorb means comprises a suction chamber having a suction opening, and a blower for sucking air from said suction chamber, while said convey means comprises a convey belt having a plurality of suction holes and mounted to cover said suction opening of said suction chamber, and a reversible motor for driving said convey belt.

3. A sheet feeding apparatus according to claim 1, wherein said sheet absorb means has a first sheet absorb portion and a second sheet absorb portion, both of which are arranged along a sheet conveying direction so that an absorb surface of said first sheet absorb portion and an absorb surface of said second absorb portion form a predetermined angle.

4. A sheet feeding apparatus according to claim 3, wherein said absorb surface of said second sheet absorb portion extends horizontally, and said absorb surface of said first sheet absorb portion is inclined downwardly.

5. A sheet feeding apparatus according to claim 3 or 4, further comprising passage means for guiding the sheet conveyed by said convey means, wherein sheet detection means for detecting the sheet is disposed in said passage means, and said control means drives said convey means in the reverse direction when a trailing end of the sheet conveyed by said convey means is detected by said sheet detection means.

6. A sheet feeding apparatus according to claim 3 or 4, wherein convey rotary means is arranged at a downstream side of said convey means, and said control means drives said convey means in the reverse direction after the sheet conveyed by said convey means is pinched between said convey rotary means to start the supply of the sheet.

7. A sheet feeding apparatus according to claim 3 or 4, wherein said first and second sheet absorb portions comprise first and second suction chambers each having a suction opening, and a blower for sucking air from said first and second suction chambers, and said convey means comprises a convey belt having a plurality of suction holes and mounted to cover said suction openings of said first and second suction chambers, and a reversible motor for driving said convey belt.

8. An image forming apparatus, comprising:

sheet supporting means for supporting sheets;

sheet absorb means for air-absorbing a lowermost sheet from among the sheets supported by said sheet supporting means;

convey means for conveying the sheet absorbed to said sheet absorb means;

regulation means for regulating a downward movement of the sheets supported by said sheet supporting means by abutting tip ends of the sheets against said regulation means;

size detection means for detecting a size of the sheets supported by said sheet supporting means; and control means for determining a sheet conveying time of said convey means on the basis of a detection result of said size detection means to drive said convey means in the reverse direction after the sheet conveying time is elapsed; and image forming means for forming an image on the sheet conveyed by said convey means.

* * * * *

UNITED STATES PATENT AND TRADEMARK OFFICE

CERTIFICATE OF CORRECTION

PATENT NO. : 5,722,652
DATED : March 3, 1998
INVENTOR(S) : Yasumi YOSHIDA, et al.

It is certified that error appears in the above-identified patent and that said Letters Patent is hereby corrected as shown below:

Column 1, line 32, delete "be".

Column 4, line 65, after "amount", insert --of--.

Column 5, line 23, delete "disenergizes" and insert therefor --de-energizes--.

Column 7, line 3, after "substantially", insert --in--.

Column 8, line 37, delete "exceed" and insert therefor --exceeds--.

Signed and Sealed this

Eighteenth Day of August, 1998

Bruce Lehman

*Attest:*

BRUCE LEHMAN

*Attesting Officer*

*Commissioner of Patents and Trademarks*